US007715529B1

(12) United States Patent
Lee et al.

(10) Patent No.: US 7,715,529 B1
(45) Date of Patent: May 11, 2010

(54) X-RAY TUBE

(75) Inventors: Chang-Yun Lee, Hwaseong-si (KR); Bae-Kyun Kim, Seongnam-si (KR); Ki-Yeo Kim, Suwon-si (KR); Sang-Su Hong, Suwon-si (KR); Sang-Hwa Kim, Suwon-si (KR); Kwang-Seok Choi, Suwon-si (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 12/469,362

(22) Filed: May 20, 2009

(30) Foreign Application Priority Data

Dec. 19, 2008 (KR) ..... 10-2008-0130333

(51) Int. Cl.
*H01J 35/30* (2006.01)

(52) U.S. Cl. ..... 378/137; 378/124

(58) Field of Classification Search ..... 378/137, 378/124, 119, 121, 125, 135, 143
See application file for complete search history.

(56) References Cited

U.S. PATENT DOCUMENTS 5,548,630 A * 8/1996 Hell et al. ..... 378/137
6,009,146 A * 12/1999 Adler et al. ..... 378/98.6

* cited by examiner

*Primary Examiner*—Hoon Song
(74) *Attorney, Agent, or Firm*—McDermott Will & Emery LLP

(57) ABSTRACT

An X-ray tube is disclosed. The X-ray tube can include a cathode configured to emit electrons, an anode that has a surface arranged parallel to an emission direction of the electrons and is configured to collide with the electrons and emit X-rays, and a guide positioned between the cathode and the anode to modify the direction in which the electrons travel such that the electrons collide with the surface of the anode. The X-ray tube according to an embodiment of the invention can be used to improve the unevenness in X-ray intensity.

5 Claims, 3 Drawing Sheets

X-RAY TUBE

CROSS-REFERENCE TO RELATED APPLICATIONS

This application claims the benefit of Korean Patent Application No. 10-2008-0130333, filed with the Korean Intellectual Property Office on Dec. 19, 2008, the disclosure of which is incorporated herein by reference in its entirety.

BACKGROUND

1. Technical Field

The present invention relates to an X-ray tube.

2. Description of the Related Art

An X-ray tube is based on the principle of generating X-rays using a cathode made from a filament and an anode made from a metallic material. When a high voltage is applied between the cathode and the anode, thermal electrons generated in the cathode are made to collide with the anode to generate X-rays.

The inside of the X-ray tube may be kept in a vacuum state, in order to avoid reductions in kinetic energy and deflections, which may otherwise occur as electrons collide with air molecules while traveling towards the target. The target can be made of a thin layer of metal, the thickness of which can be determined in consideration of the penetration depth of the electrons and heat-absorbing capacity.

The X-ray tube can be divided into a fixed type and a rotating type, according to the operation of the anode. A rotating X-ray tube can be substantially the same as the fixed X-ray tube, except that the anode may rotate to better disperse the heat generated in the target.

A conventional X-ray tube, such as that illustrated in FIG. 1, may experience an anode heel effect, in which the intensity of the X-rays is higher in the direction of the cathode from the midpoint, so that the effective focal spot size is larger, while the intensity of the X-rays is lower in the direction of the anode, so that the effective focal spot size is smaller.

Thus, in practice, a technician may move towards the parts closer to the cathode when acquiring an image for a thick portion and move towards the parts closer to the anode when acquiring an image for a thin portion, when operating an X-ray machine. This uneven distribution of X-ray intensity is caused by the inclination of the anode.

SUMMARY

An aspect of the invention aims to provide an X-ray tube, in which the unevenness in X-ray intensity is improved.

Another aspect of the invention provides an X-ray tube that includes a cathode, an anode, and a guide. The cathode can be configured to emit electrons. The anode can have a surface arranged parallel to an emission direction of the electrons and can be configured to collide with the electrons to emit X-rays. The guide can be positioned between the cathode and the anode, to modify the direction in which the electrons travel such that the electrons collide with the surface of the anode.

The guide can include a magnet, and the anode can include many targets having different materials. Here, the targets may be aligned in a row along the direction in which the electrons are emitted.

The X-ray tube can further include a filter, which may be arranged in a path of the X-rays, to filter bremsstrahlung. The cathode can be made to include carbon nanotubes.

Additional aspects and advantages of the present invention will be set forth in part in the description which follows, and in part will be obvious from the description, or may be learned by practice of the invention.

DETAILED DESCRIPTION

Figure 1:
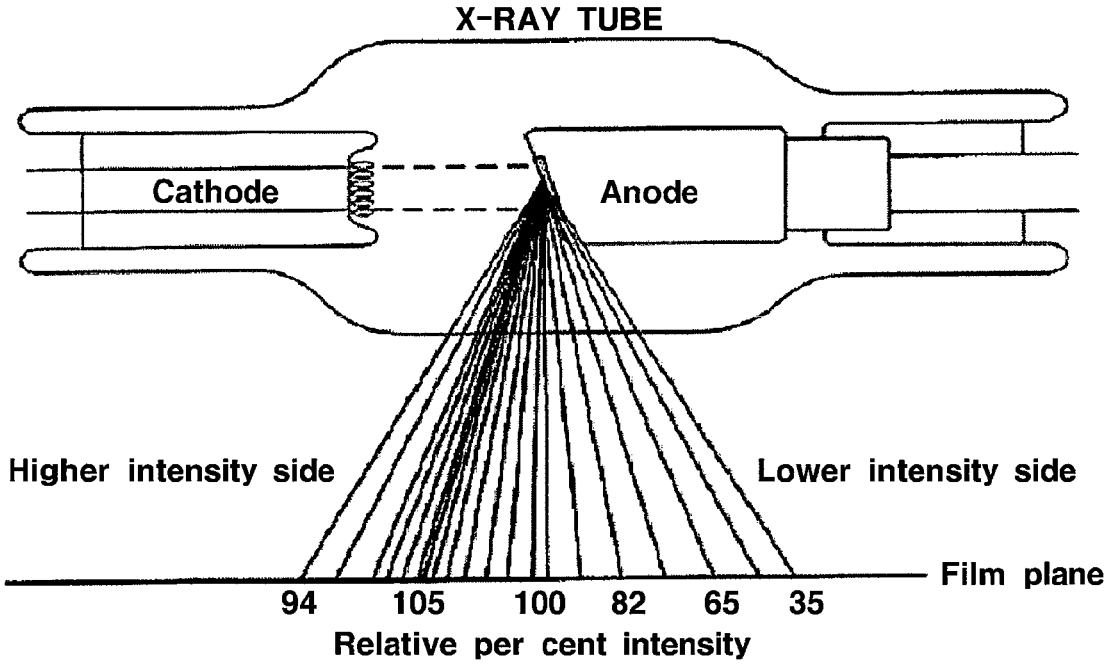
FIG. 1 PRIOR ART
FIG. 1 illustrates the anode heel effect in an X-ray tube according to the related art.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention.

The X-ray tube according to certain embodiments of the invention will be described below in more detail with reference to the accompanying drawings. Those components that are the same or are in correspondence are rendered the same reference numeral regardless of the figure number, and redundant explanations are omitted.

Figure 2:
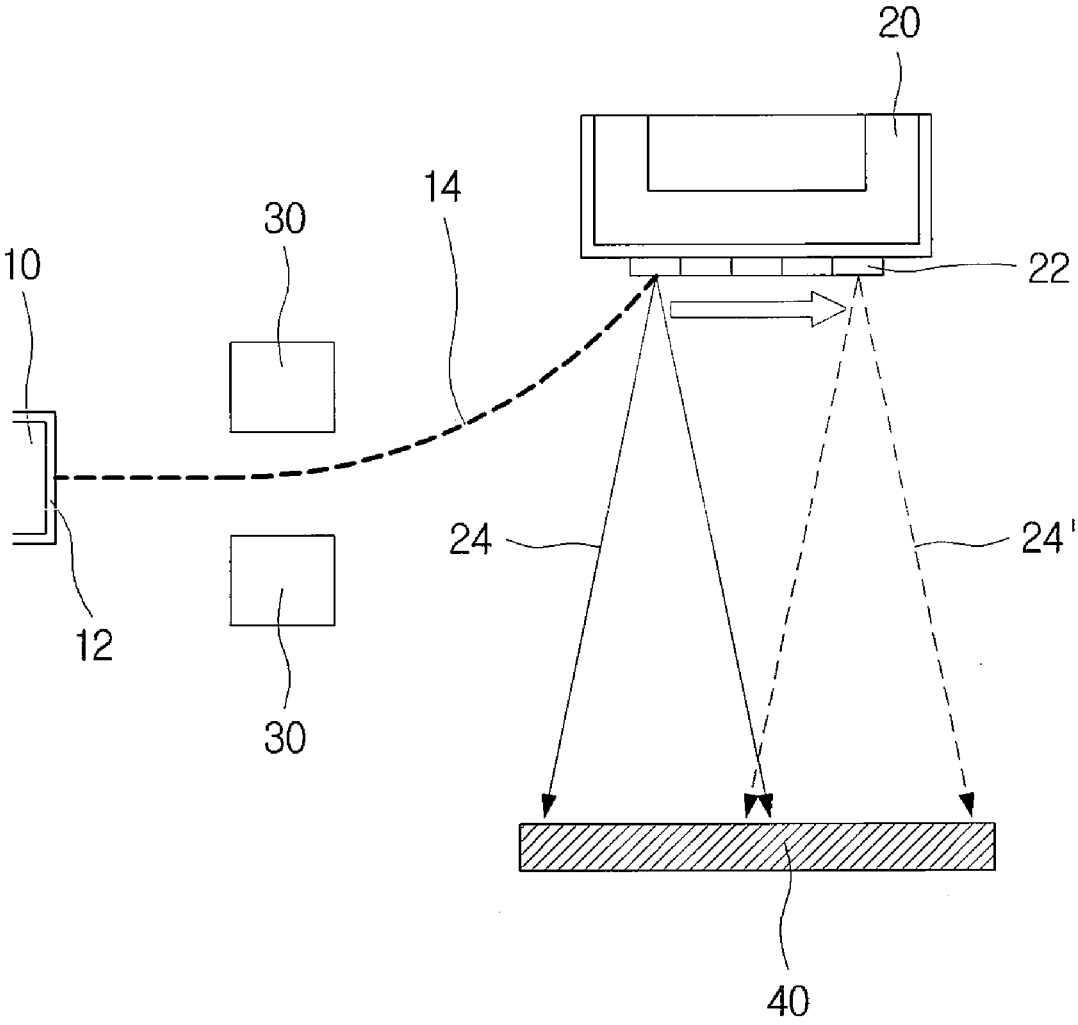
FIG. 2 illustrates the structure of an X-ray tube according to an embodiment of the invention.
Figure 3:
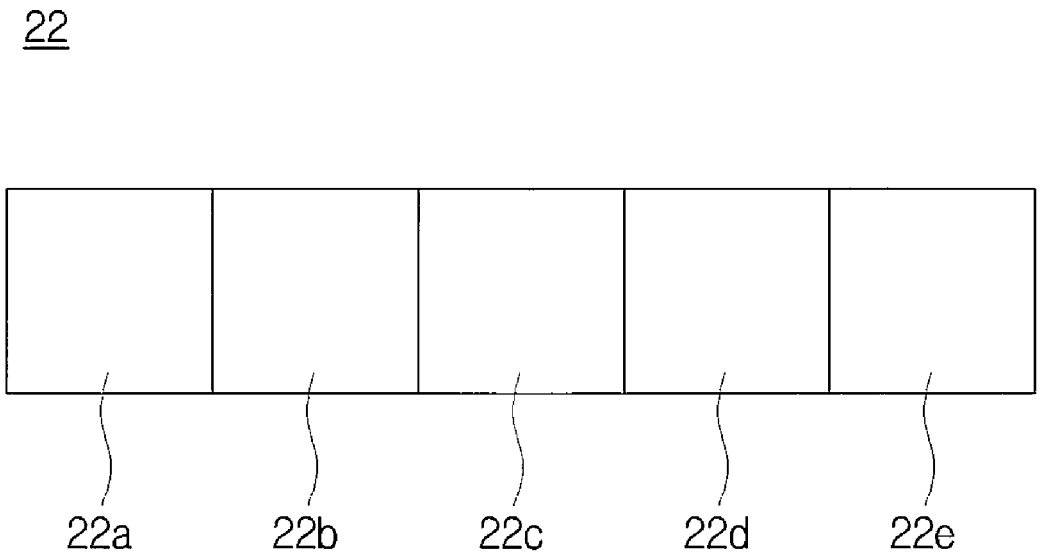
FIG. 3 is a plan view illustrating the target array in FIG. 2.

FIG. 2 is a drawing illustrating the structure of an X-ray tube according to an embodiment of the invention, and FIG. 3 is a plan view illustrating the target array in FIG. 2. In FIG. 2 and FIG. 3, there are illustrated a cathode 10, an electron emitter 12, an anode 20, a target array 22, a guide 30, and a filter 40.

As in the example shown in FIG. 2, an X-ray tube according to an embodiment of the invention can be composed mainly of a cathode 10, an anode 20, a guide 30, and a filter 40.

The cathode 10 can be arranged inside a vacuum housing (not shown) to generate electrons. The cathode 10 can include an electron emitter 12, which emits electrons, and a focusing apparatus (not shown), which converges the electrons generated in the electron emitter 12 to move in a particular direction.

An example of an electron emitter 12 is a filament, which may be a coil made from a material such as tungsten. When an electric current is supplied to the filament, the filament may be heated, and the heated filament may emit electrons in every direction. Thus, a focusing apparatus (not shown) can be used, which converges the electrons to a particular direction, so that the electrons may be transferred precisely to the anode 20.

Besides using the filament, the electron emitter 12 may also be implemented using carbon nanotubes. The use of carbon nanotubes makes it possible to obtain electron emission at normal temperature, greatly improving the expected life span of the radiation source. An electron emitter 12 using carbon nanotubes can also provide a very high efficiency in emitting electrons, so that X-rays may be generated with higher intensity and higher efficiency, and can be fabricated in compact sizes, so that the value of the final product may be increased.

The anode 20 can collide with the electrons emitted from the cathode 10 to emit X-rays 24 and 24'. For this, the anode 20 can include a target 22 made from a metallic material. Here, the target 22 can be arranged parallel to the general direction in which the electrons are emitted from the cathode 10. In other words, the initial emission direction of the electrons can be parallel to the surface of the target 22, as in the example shown in FIG. 2. It should be noted that the term "parallel" is not limited to an exact, mathematical meaning of the word, but is used to convey a meaning of a general parallel that allows for mechanical and design tolerances, etc.

A guide 30 can be positioned between the cathode 10 and the anode 20 and can control the path 14 of the electrons. A magnet having an N-pole and an S-pole, such as an electromagnet, etc., can be utilized as the guide 30. By arranging the guide 30, which uses an electromagnet, for example, at the front of the cathode 10, the magnitude, direction, etc., of the magnetic field around the cathode 10 can be modified, whereby the path 14 of the electrons emitted from the cathode 10 may also be modified.

In this embodiment, the target 22 can be arranged parallel to the emission direction of the electrons emitted from the cathode 10, and the guide 30 can refract the path 14 of the electrons towards the target 22, so that the electrons may collide with the target 22.

By modifying the magnitude of the magnetic field around the cathode 10, the degree to which the path 14 of the electrons is refracted can be modified, and hence the position on the target where the electrons collide can also be modified.

Taking advantage of this fact, the target 22 in this embodiment can be formed as a target array 22, which is made from a multiple number of targets 22*a*, 22*b*, 22*c*, 22*d*, and 22*e* that are made from different materials. According to this embodiment, a variety of characteristic X-rays and bremsstrahlung can be obtained from a single X-ray tube by using several targets having different materials, instead of using one target made of a single material.

With the several targets 22*a*, 22*b*, 22*c*, 22*d*, and 22*e* aligned in a row along the emission direction of the electrons, the target to which the electrons collide can be determined by changing the magnitude of the magnetic field around the cathode 10. For example, the electrons can be made to collide with the surface of the target 22*a* farthest from the cathode 10 by lowering the magnitude of the magnetic field. Conversely, the electrons can be made to collide with the target 22*e* closest to the cathode 10 by increasing the magnitude of the magnetic field. FIG. 3 illustrates an example of a target 22 that is composed of a row of targets 22*a*, 22*b*, 22*c*, 22*d*, and 22*e* having different materials, and the table below presents the atomic numbers and K-alpha energies of a few typical target materials.

| Element | Chemical Symbol | Atomic Number (Z) | K X-ray Energy (KeV) |
|---|---|---|---|
| Tungsten | W | 74 | 69 |
| Lead | Pb | 82 | 75 |
| Molybdenum | Mo | 42 | 20 |
| Iodine | I | 53 | 28 |
| Rhodium | Rh | 45 | 23 |
| Silver | Ag | 47 | 22 |
| Copper | Cu | 29 | 8 |
| Tantalum | Ta | 73 | 57 |
| Rhenium | Re | 75 | 61 |
| Osmium | Os | 76 | 63 |
| Iridium | Ir | 77 | 64 |
| Platinum | Pt | 78 | 66 |
| Gold | Au | 79 | 68 |
| Uranium | U | 92 | 98 |

A target base 26 can be coupled to the target 22, where a material having a high thermal conductivity and a low atomic number (Z<10) may be selected for the target base 26 in consideration of its heat-releasing effect.

After positioning the components such that the emission direction of the electrons and the surface of the target 22 are parallel, as described above, forming the incident direction of the electrons closer to the direction normal to the target can improve the anode heel effect, as illustrated in FIG. 1, that is caused by the inclination of the anode's surface. In other words, 1) the increasing of the effective focal spot size in the direction of the cathode can be reduced, 2) the changes in the effective focal spot size due to the inclination of the anode surface can be reduced, and 3) the uneven distribution of X-ray intensity, where the intensity increases towards the cathode and decreases towards the anode, can be reduced.

A filter 40 for filtering bremsstrahlung can be positioned in a path of the X-rays 24 and 24', which are generated at the anode 20 when the electrons collide with the target 22. In general, the radiation intensity that contributes to obtaining an X-ray image includes less than 20% from characteristic X-rays and more than 80% from bremsstrahlung. By using the filter 40 to filter the bremsstrahlung, monochromatic X-rays, which only use characteristic X-rays, can be implemented. This results in an image that has higher sharpness and higher contrast.

As described above, an X-ray tube according to an embodiment of the invention can be used to improve the uneven distribution of X-ray intensity, as well as to provide X-rays having different energy properties. Furthermore, the X-ray tube can be used to implement monochromatic X-rays consisting only of characteristic X-rays, to provide an image that has higher sharpness and higher contrast.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention.

Many embodiments other than those set forth above can be found in the appended claims.

What is claimed is:

1. An X-ray tube comprising:

a cathode configured to emit electrons;

an anode having a surface thereof arranged parallel to an emission direction of the electrons, the anode configured to collide with the electrons to emit X-rays; and a guide interposed between the cathode and the anode, the guide configured to modify a traveling direction of the electrons such that the electrons collide with the surface of the anode, wherein the anode comprises a plurality of targets having different materials.

2. The X-ray tube of claim 1, wherein the guide comprises a magnet.

3. The X-ray tube of claim 1, wherein the plurality of targets are aligned in a row along an emission direction of the electrons.

4. The X-ray tube of claim 1, further comprising a filter arranged in a path of the X-rays, the filter configured to filter bremsstrahlung.

5. The X-ray tube of claim 1, wherein the cathode comprises carbon nanotubes.

* * * * *